US007679020B2

(12) United States Patent
Schulz et al.

(10) Patent No.: US 7,679,020 B2
(45) Date of Patent: Mar. 16, 2010

(54) ELECTRICAL SERVICE SWITCHING DEVICE WITH AN ARC BLOWOUT DEVICE

(75) Inventors: Bernhard Schulz, Wiesloch (DE); André Dickgiesser, Sandhausen (DE)

(73) Assignee: ABB AG, Mannheim (DE)

( * ) Notice: Subject to any disclaimer, the term of this patent is extended or adjusted under 35 U.S.C. 154(b) by 99 days.

(21) Appl. No.: 12/153,978

(22) Filed: May 28, 2008

(65) Prior Publication Data

US 2008/0296264 A1 Dec. 4, 2008

(30) Foreign Application Priority Data

May 31, 2007 (DE) ..... 10 2007 025 537

(51) Int. Cl.
*H01H 9/30* (2006.01)

(52) U.S. Cl. ..... 218/26; 218/24; 218/25; 335/201

(58) Field of Classification Search ..... 218/23–28; 335/201

See application file for complete search history.

(56) References Cited

U.S. PATENT DOCUMENTS

| | | | | |
|---|---|---|---|---|
| 4,585,912 | A * | 4/1986 | Fischer et al. | 218/158 |
| 4,962,406 | A * | 10/1990 | Walker et al. | 335/201 |
| 5,109,146 | A * | 4/1992 | Maenishi | 218/26 |
| 7,259,646 | B2 * | 8/2007 | Rab et al. | 335/201 |

FOREIGN PATENT DOCUMENTS

| | | | |
|---|---|---|---|
| DE | 3 82 256 | A | 9/1964 |
| DE | 12 46 851 | B | 8/1967 |
| DE | 195 18 049 | A1 | 11/1996 |
| DE | 101 17 346 | B4 | 11/2002 |
| DE | 102 42 310 | A1 | 7/2003 |
| DE | 10 2005 007 282 | A1 | 8/2006 |

OTHER PUBLICATIONS

German Search Report.

* cited by examiner

*Primary Examiner*—Ramon M Barrera
(74) *Attorney, Agent, or Firm*—Buchanan Ingersoll & Rooney PC

(57) ABSTRACT

The disclosure relates to an electrical service switching device, in particular a circuit breaker, motor circuit breaker or the like, having a housing which has two housing halves and connecting means for electrical connection to busbars and/or power lines, having at least one electrical switching contact on which an arc is struck in an initial arcing chamber on disconnection of the electrical contact, with an arc quenching unit being provided adjacent to this, in order to quench the arc. An AC blowout device which comprises two iron plates adjacent to the initial chamber area in the lateral direction and guides the arc into the arc quenching device by magnetic interaction during AC operation, is provided. The housing wall has an opening in the area of the iron plates, through which a permanent magnet can be inserted in order to create an AC/DC blowout device, which guides the arc into the arc quenching device in both AC and DC operation, when the housing is assembled.

9 Claims, 2 Drawing Sheets

ELECTRICAL SERVICE SWITCHING DEVICE WITH AN ARC BLOWOUT DEVICE

RELATED APPLICATION

This application claims priority under 35 U.S.C. §119 to German Patent Application No. 10 2007 025 537.5 filed in Germany on May 31, 2007, the entire content of which is hereby incorporated by reference in its entirety.

TECHNICAL FIELD

The disclosure relates to an electrical service switching device having an arc blowout device. By way of example, the disclosure may be used for circuit breakers and motor circuit breakers.

BACKGROUND INFORMATION

A service switching device of this generic type has a housing which comprises two housing halves and has connecting means for electrical connection to busbars and/or power lines.

Electrical service switching devices of this generic type are frequently in the form of mechanically acting circuit breakers which are used to disconnect electrical lines which are loaded with overcurrents at a high current level from the power supply system in the event of a fault. A fixed and a moving contact piece are normally provided for this purpose in an initial arcing chamber, and are connected to the respective connecting terminals. On opening of the switching contact, that is to say when the moving contact piece is lifted off the stationary contact piece, a switching arc is struck, and is quenched in an arc quenching device provided for this purpose. The arc that is struck commutates from the open contact pieces onto arc guide rails in order then to be split in an arc splitter stack, which is also referred to as an arc quenching chamber, where a high arc voltage is produced for current limiting, thus quenching the arc.

DE 102 42 310 A1 discloses an arc quenching arrangement for an electrical service switching device which comprises an arcing chamber (in which an arc is struck between a stationary and a moving contact piece during a switching operation) and an arc splitter stack which has a plurality of arc quenching plates, and into which the arc is guided via guide rails.

In order to increase the switching rating of service switching devices, various measures have been proposed in order to speed up the movement of the switching arc to the arc quenching device. Appliances whose switching rating has been increased in this way are also referred to as high-power switching devices.

DE 195 18 049 A1 discloses an electrical service switching device of this generic type having an initial arcing chamber and an arc quenching unit arranged adjacent to it. The quenching effect is assisted by an AC blowout device which uses an iron plate to produce a so-called magnetic blowout film which interacts magnetically with the arc in order to speed up its movement in the direction of the arc quenching unit. The iron plate can be arranged on one side of the chamber area of the initial arcing chamber.

In other service switching devices of this generic type, an AC blowout device is provided which comprises two iron plates adjacent to the initial chamber area in the lateral direction. The expression "iron plates" is used here in order to denote plates which have ferromagnetic characteristics. In addition to plates composed of iron, these may also be plates composed of some other ferromagnetic material, or plates composed of a composite material with a ferromagnetic component, or else plastic-extrusion-coated iron plates or plastic-extrusion-coated plates composed of another material with ferromagnetic characteristics.

The magnetic interaction which is used to assist the movement of the arc struck on contact opening in the direction of the arc quenching device in this case occurs only during AC operation, that is to say alternating-current operation. Service switching devices of this generic type are therefore also referred to as AC switching devices or AC high-power switching devices.

However, an arc also occurs during a switching operation in DC power supply systems or in direct-current operation, and should be quenched as quickly as possible in the arc quenching device. DC operation is subject to the additional difficulty that there is no zero crossing, and the movement of the arc into the arc quenching device should therefore be assisted by an externally generated magnetic blowout field. Corresponding appliances which are suitable for direct-current operation are also referred to in the following text as DC switching devices or DC high-power switching devices. DC switching devices are known from the prior art having permanent magnets whose magnetic field acts appropriately on the magnetic field formed by the arc, thus guiding the arc into the arc quenching unit.

With the exception of the blowout device, AC and DC switching devices are generally largely physically identical. However, since the permanent magnet for generation of the DC blowout field is fitted in the interior of the housing in known DC switching devices, a distinction must be drawn even at the start of the final assembly process for appliance manufacture between an AC appliance with iron plates and a DC appliance with a permanent magnet. Two separate production lines are even often provided, one to manufacture AC appliances and one to manufacture DC appliances.

DE 10 2005 007 282 A1 describes a service switching device in which there is no need to decide until a later time during final assembly whether the aim is to produce an AC or a DC appliance. Either iron plates to manufacture an AC appliance or permanent-magnet plates to manufacture a DC appliance are in this case inserted for this purpose into externally accessible recesses in the housing wall. However, even in this case, it is necessary to state from the start whether an appliance is intended to be an AC appliance or a DC appliance, and retrospective conversion from an AC appliance to a DC appliance is not possible.

Since the majority of the service switching devices of this generic type for which there is a demand in the market are AC appliances, but a manufacturer of service switching devices must be able to supply both AC and DC appliances, the provision of a separate production line for DC appliances represents a not inconsiderable cost factor.

SUMMARY

A service switching device is disclosed which is manufactured as an AC appliance and can be converted if required to a DC appliance in a simple and low-cost manner, without any need to replace any component or to open the housing.

An electrical service switching device is disclosed, in particular a circuit breaker, motor circuit breaker or the like, having a housing which has two housing halves and connecting means for electrical connection to busbars and/or power lines, having at least one electrical switching contact on which an arc is struck in an initial arcing chamber on disconnection of the electrical contact, with an arc quenching unit being provided adjacent to this, in order to quench the arc, wherein an AC blowout device which comprises two iron plates adjacent to the initial chamber area in the lateral direction and assists the guidance of the arc into the arc quenching device by magnetic interaction during AC operation, is provided, and in that the housing wall has an opening in the area of the iron plates, through which a permanent magnet can be inserted in order to create an AC/DC blowout device, which assists arc guidance in both AC and DC operation, when the housing is assembled.

In another aspect, an electrical service switching device is disclosed, comprising: a housing which has two housing halves; connecting means for electrical connection to busbars and/or power lines, having at least one electrical switching contact on which an arc is struck in an initial arcing chamber on disconnection of the electrical switching contact, with an arc quenching unit being provided adjacent to this, in order to quench the arc; and an AC blowout device which comprises two iron plates disposed in a lateral direction in relation to the initial arching chamber, wherein a wall of the housing has an opening in relation to the iron plates, through which a permanent magnet can be inserted in order to create an AC/DC blowout device, for arc guidance in either AC or DC operation.

BRIEF DESCRIPTION OF THE DRAWINGS

The disclosure as well as further advantageous refinements and improvements of the disclosure will be explained and described in more detail with reference to the drawings, which illustrate one exemplary embodiment of the disclosure, and in which.

DETAILED DESCRIPTION

Figure 1:
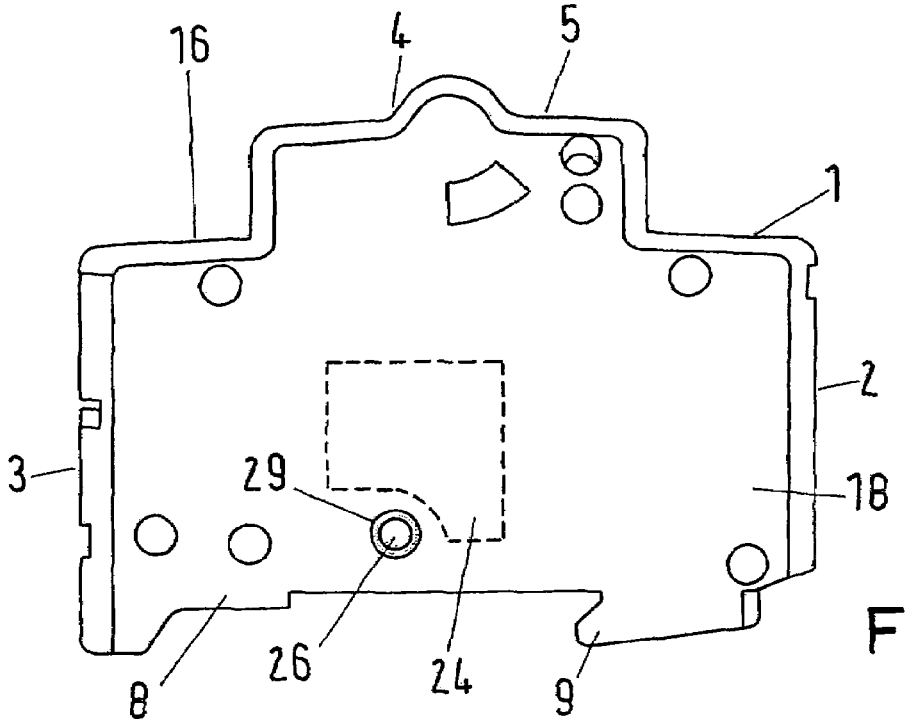
FIG. 1 shows a side view of an exemplary service switching device according to the disclosure.

According to the disclosure, an exemplary service switching device of this generic type therefore has an AC blowout device which comprises two iron plates adjacent to the initial chamber area in the lateral direction and assists the guidance of the arc into the arc quenching device by magnetic interaction during AC operation, and the housing wall has an opening in the area of the iron plates, through which a permanent magnet can be inserted in order to create an AC/DC blowout device, which assists arc guidance in both AC and DC operation, when the housing is assembled.

In this case, once the permanent magnet has been inserted into the opening, a magnetic circuit is formed which comprises the permanent magnet as its core and the iron plates as parallel opposite yoke plates, so that a magnetic blowout field is formed between the iron plates.

In this case, the permanent magnet does not necessarily need to touch the iron plates. It is sufficient for it to be in the vicinity of the iron plates after insertion, so that the air gap between the permanent magnet and the iron plates is very narrow. The magnetic reluctance of the air gap is then low, and the magnetic field lines run at right angles to the iron plates, emerging in the area between the iron plates, where they form the DC blowout field.

With an exemplary service switching device according to the disclosure, the permanent magnet can be fitted from the outside retrospectively without the housing having to be opened or an already fitted part having to be replaced for this purpose. An AC switching device can therefore be converted to a DC switching device by retrospective insertion of a permanent magnet into the externally accessible opening.

There is no longer any need for the production line at the switchgear manufacturer's to be split into an AC path and a DC path, and a single assembly line is sufficient. In this assembly line, the distinction between the manufacture of an AC switching device or a DC switching device results from the insertion of the permanent magnet as the final step in the production line for production of a DC switching device. This final step is then omitted for production of an AC switching device. In this case, AC and DC switching devices are identical, except for the permanent magnet.

An exemplary service switching device according to the disclosure could also be converted to a DC device even after delivery to the customer, by the customer himself inserting a permanent magnet component, obtained as a spare part from the manufacturer, into the opening. The appliance manufacturer would then need to manufacture and deliver only AC switching devices, thus considerably simplifying his production process. The customer can then himself convert an AC switching device to a DC switching device, as required.

According to one exemplary embodiment of the disclosure, the iron plates of the blowout device are formed by plastic-sheathed iron initial chamber plates arranged in the area of the initial arcing chamber. In this embodiment, the initial chamber plates designed in this way according to the disclosure carry out two functions, specifically on the one hand as initial chamber plates to form a lateral boundary and for spatial matching of the initial chamber area to the size of the opening accommodating the arc in the arc splitter stack arrangement, and secondly as part of the blowout device.

A further exemplary embodiment of the disclosure provides that a guide channel, which is directed into the housing interior and has insulating walls, for the permanent magnet is adjacent to the opening. In one exemplary development of the disclosure, this can be closed on the side opposite the opening. For example, it can end at the housing wall opposite the opening, which then has no opening there and in this way closes the guide channel. The guide channel surrounds the permanent magnet and contributes to its positional stability with respect to the iron plates. Its walls are sufficiently thin and composed of a material such that they have virtually no adverse effect on the magnetic field of the permanent magnet, for example being composed of a thermosetting plastic or thermoplastic.

Once the permanent magnet has been inserted, the opening can itself be closed by a cover. Once the opening has been closed, the permanent magnet is fixed in position in the interior of the switching device without having to be adhesively bonded.

The cover could, of course, be omitted, but the permanent magnet would then have to be fixed in position in the opening in some other manner, for example by adhesive bonding, or by means of an interference fit.

Figure 3:
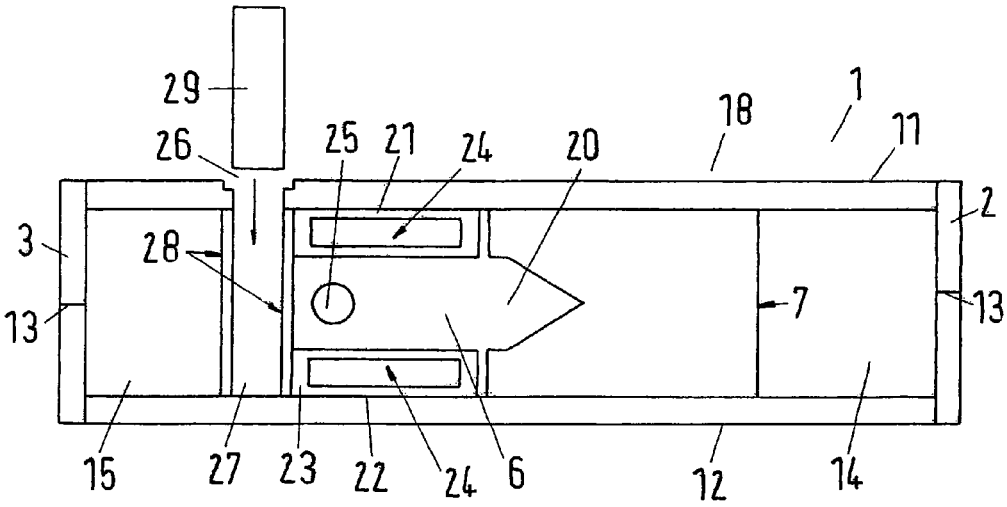
FIG. 3 shows a partial section through an exemplary service switching device according to the disclosure.

First of all, reference will be made to FIG. 3 in conjunction with FIG. 1. FIG. 3 shows a section through an exemplary service switching device. With regard to the design of an electrical service switching device such as this which can be mounted on a top-hat profile mounting rail, reference is made to DE 102 42 310 A1, which was cited in the introductory part of the description. In a narrow, cuboid housing 1 which has a facing and rear front face 5, 16, two narrow faces 2, 3, an attachment face 8 and broad faces 17, 18 connecting the narrow faces, a switching device such as this has connecting means on at least one narrow face 2, 3 for connection to busbars and/or connecting lines, so-called input and output connections, an electromagnetic release for disconnection of short-circuit currents, a thermal release for disconnection of overcurrents, a switching mechanism, a switching toggle 4 on the facing front face 5 of the housing, at least one switching contact with at least one stationary and at least one moving switching contact piece, arc guide rails for guiding an arc, indicated by the circle with the reference symbol 25, from an initial arcing chamber area 6 into a current-limiting arc quenching device, as well as installation means 9, for mounting on a top-hat profile mounting rail, on the attachment face 8 of the housing. By way of example, the installation means 9 is a fixed tab which, with a moving tab opposite it, engages behind the free limbs of the top-hat profile mounting rail, such that it latches in place. If more than one switching contact is provided, it is, of course, also possible to provide more than one arc quenching device, including arc guide rails, as required.

The service switching device—a circuit breaker or a motor circuit breaker—has a housing 1 which is normally composed of two halves 11, 12, which are joined together at a connection joint 13, with the housing 1 being composed of an insulating plastic material. The two housing halves 11, 12 are brought into contact with one another such that the shell-like housing halves create an installation area 14 for the components of the electrical switching device, that is to say for the electromagnetic release and the thermal release, a connection area 15 for accommodation of a connecting terminal, as well as the initial arcing chamber area 6 and an area for accommodation of the current-limiting arc quenching device 7. The plane in which the shell-like housing halves 11, 12 are split is indicated by the connection joint 13.

Figure 2:
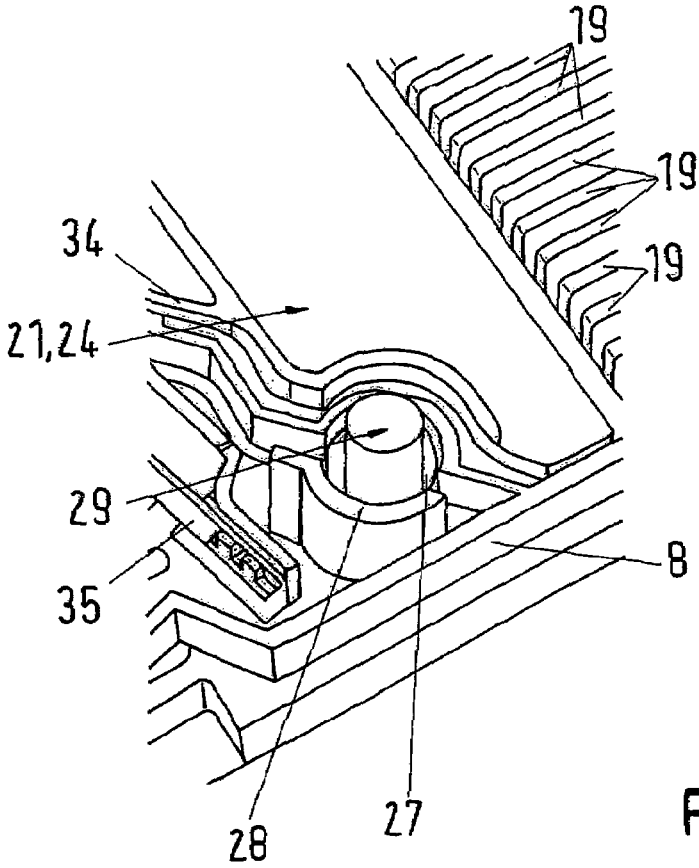
FIG. 2 shows a partial view into an open service switching device according to the disclosure.

The arc quenching device 7 is a stack arrangement composed of ferromagnetic arc quenching plates 19, see FIG. 2, which are held at a distance from one another by a holding apparatus and have a V-shaped recess 20 on the arc inlet side.

Initial chamber plates 21, 23 are arranged on the two broad faces 17, 18 of the initial arcing chamber area 6 such that they match the physical extent of the initial arcing chamber area 6 to the opening geometry of the V-shaped recess 20. This assists the guidance of the arc 25 from its commutation point to the inlet side of the arc quenching device 7.

The initial chamber plates are iron plates 24 surrounded with a plastic casing 23. This has two purposes. Firstly, the inner face of the initial arcing chamber area 6 facing the arc 25 is formed from insulating material, which is essential for guidance of the arc 25. Secondly, a magnetic blowout field can be created by magnetic interaction between the arc 25 (when this is an alternating-current arc) and the iron plates 24 and contributes to speeding up the guidance of the arc 25 into the arc quenching device 7.

The housing broad face 18 has an opening 26 in the area of the iron plates 24. There is a guide channel 27 adjacent to the opening 26, in the direction of the interior of the housing. The guide channel 27 has insulating walls 28 which provide it with a circular internal cross section. The guide channel 27 is closed on the opposite broad face 17 where the insulating walls 28 are located on the housing broad face 17. The insulating walls 28 of the guide channel 27 are formed from the same insulating material as the housing halves 11, 12; they can be produced in an injection-moulding process during the production of the housing or of the housing halves. They could, of course, also be inserted retrospectively and connected to the housing half integrally.

A cylindrical permanent magnet 29 can be inserted into the guide channel 27 through the opening 26. Its external dimensions correspond to the internal diameter of the guide channel 27, so that it is held in the guide channel 27. Once the permanent magnet 29 has been inserted into the guide channel 27, the opening 26 is closed by a cover plate 30, see FIG. 4, so that the permanent magnet 28 can no longer escape from the guide channel 27, and is fixed in it. At the same time, the cover plate 30 protects the permanent magnet 29 against disturbing environmental influences such as dust or moisture.

Figure 4:
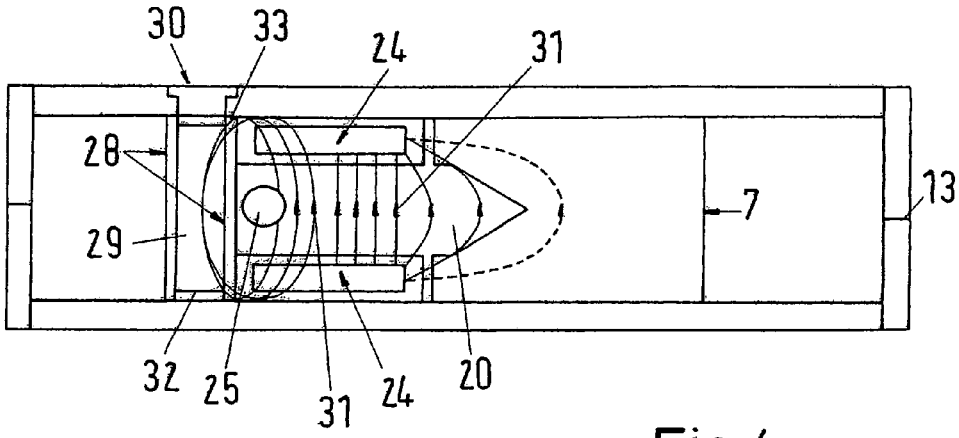
FIG. 4 shows the partial section as shown in FIG. 3, with a permanent magnet inserted.

Reference will now be made to FIG. 4, which shows a section view of an exemplary service switching device according to the disclosure with a permanent magnet 29 inserted. The permanent magnet 29 and the iron plates 24 form a magnetic circuit. The guide channel 27 is arranged sufficiently close to the iron plates 24 that the air gap between the permanent magnet 29 and the iron plates is sufficiently narrow not to represent any significant magnetic reluctance. The magnetic field lines 31 then run from the north pole 32 of the permanent magnet 29 through the iron plate 24 adjacent to it and through the initial arcing chamber area 6 to the opposite iron plate 24 and to the south pole 33 of the permanent magnet. This results in a magnetic blowout field, externally excited by the permanent magnet 29, being produced in the initial arcing chamber area 6, in order to assist the movement of the arc 25. As can be seen, the field line density and therefore the field strength decrease in the direction of the V-shaped recess in the arc quenching device 7. The force on the arc acts in the direction of the decreasing field strength, that is to say into the arc quenching device 7.

This illustrates the advantage of the arrangement according to the disclosure. If the permanent magnet is not inserted, see FIG. 3, the service switching device is an AC high-power switch, because the magnetic blowout field is formed between the two iron plates 24 only when an alternating-current arc is struck during alternating-current operation. There would be no magnetic blowout field between the two iron plates 24 during direct-current operation and any direct-current arc struck on contact opening would enter the arc quenching device only at the "normal" speed. The service switching device as shown in FIG. 3 is therefore only a standard switch in direct-current operation.

The insertion of the permanent magnet 29, see FIG. 4, converts the AC high-power switch to a so-called UC high-power switch (a so-called universal-current high-power switch) which makes it possible to drive the arc into the arc quenching device 7 faster with the aid of a magnetic blowout field both in direct-current operation and in alternating-current operation. No action on the appliance is required to do this, and no component need be replaced either; all that is required is to insert the permanent magnet 29 into the guide channel 27 through the opening 26, with the permanent magnet 29 then being fixed in it by the cover plate 30.

FIG. 2 shows a detail view of the mutual arrangement between the permanent magnet 29 and the initial chamber plates 21 and the iron plates 24. In addition to the arc quenching plates 19 which form the arc quenching device, the figure also shows the lower arc guide rail 34 and the end of the bimetallic strip 35.

In the external view in FIG. 1, the initial chamber plate 24 arranged in the interior of the housing is indicated by a dashed contour line, so that this illustration also shows the mutual position of the permanent magnet 21 and the initial chamber plate 24. The permanent magnet 29 could, of course, also be arranged in the vicinity of any other point on the initial chamber plates 24 in order to carry out the function according to the disclosure. The position of the permanent magnet 29 is governed by the arrangement of the other components and parts in the interior of the service switching device, because it can be arranged only where space is available for this purpose in the interior of the service switching device.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

| List of reference symbols | |
|---|---|
| 1 | Housing |
| 2 | Narrow face |
| 3 | Narrow face |
| 4 | Switching toggle |
| 5 | Facing front face |
| 6 | Initial arcing chamber area |
| 7 | Arc quenching device |
| 8 | Attachment face |
| 9 | Installation means |
| 11 | First housing half |
| 12 | Second housing half |
| 13 | Connection joint |
| 14 | Installation area |
| 15 | Connection area |
| 16 | Rear front face |
| 17 | Broad face |
| 18 | Broad face |
| 19 | Arc quenching plate |
| 20 | V-shaped recess |
| 21 | Initial chamber plate |
| 22 | Initial chamber plate |
| 23 | Plastic casing |
| 24 | Iron plate |
| 25 | Arc |
| 26 | Opening |
| 27 | Guide channel |
| 28 | Insulating wall |
| 29 | Permanent magnet |
| 30 | Cover plate |
| 31 | Field lines |
| 32 | North pole |
| 33 | South pole |
| 34 | Arc guide rails |
| 35 | Bimetallic strip |

What is claimed is:

1. An electrical service switching device having a housing which has two housing halves and connecting means for electrical connection to busbars and/or power lines, having at least one electrical switching contact on which an arc is struck in an initial arcing chamber on disconnection of the electrical contact, with an arc quenching unit being provided adjacent to this, in order to quench the arc, wherein an AC blowout device which comprises two iron plates adjacent to the initial chamber area in the lateral direction and assists the guidance of the arc into the arc quenching device by magnetic interaction during AC operation, is provided, and wherein the housing wall has an opening in the area of the iron plates, through which a permanent magnet can be inserted in order to create an AC/DC blowout device, which assists arc guidance in both AC and DC operation, when the housing is assembled.

2. The electrical service switching device according to claim 1, wherein the iron plates of the blowout device are formed by plastic-sheathed iron initial chamber plates arranged in the area of the initial arcing chamber.

3. The electrical service switching device according to claim 2, wherein a guide channel, which is directed into the housing interior and has insulating walls, for the permanent magnet is adjacent to the opening.

4. The electrical service switching device according to claim 3, wherein the guide channel is closed on the side opposite the opening.

5. The electrical service switching device according to claim 3, wherein the opening can be closed by a cover once the permanent magnet has been inserted.

6. The electrical service switching device according to claim 1, wherein, once the permanent magnet has been inserted into the opening, a magnetic circuit is formed such that a magnetic blowout field, induced by the permanent magnet, is formed between the iron plates.

7. The electrical service switching device according to claim 5, wherein, once the permanent magnet has been inserted into the opening, a magnetic circuit is formed such that a magnetic blowout field, induced by the permanent magnet, is formed between the iron plates.

8. The electrical service switching device according to claim 1, wherein the electrical service switching device is one of a circuit breaker or a motor circuit breaker.

9. An electrical service switching device comprising:

a housing which has two housing halves;

connecting means for electrical connection to busbars and/or power lines, having at least one electrical switching contact on which an arc is struck in an initial arcing chamber on disconnection of the electrical switching contact, with an arc quenching unit being provided adjacent to this, in order to quench the arc; and an AC blowout device which comprises two iron plates disposed in a lateral direction in relation to the initial arching chamber, wherein a wall of the housing has an opening in relation to the iron plates, through which a permanent magnet can be inserted in order to create an AC/DC blowout device, for arc guidance in either AC or DC operation.

* * * * *